US007955143B2

(12) United States Patent
Zhang

(10) Patent No.: US 7,955,143 B2
(45) Date of Patent: Jun. 7, 2011

(54) ELECTRIC CONTACTOR AND ELECTRONIC EQUIPMENT

(75) Inventor: Shoubin Zhang, Shizuoka (JP)

(73) Assignee: Sony Corporation, Tokyo (JP)

( * ) Notice: Subject to any disclaimer, the term of this patent is extended or adjusted under 35 U.S.C. 154(b) by 71 days.

(21) Appl. No.: 12/428,524

(22) Filed: Apr. 23, 2009

(65) Prior Publication Data

US 2009/0269993 A1 Oct. 29, 2009

(30) Foreign Application Priority Data

Apr. 24, 2008 (JP) ..... P2008-113781

(51) Int. Cl.
*H01R 13/05* (2006.01)

(52) U.S. Cl. ..... 439/825

(58) Field of Classification Search ..... 439/825, 439/826, 669, 312; 29/874
See application file for complete search history.

(56) References Cited

FOREIGN PATENT DOCUMENTS

| | | |
|---|---|---|
| JP | 2005 234563 | 9/2005 |
| JP | 2007 115505 | 5/2007 |

*Primary Examiner* — Alexander Gilman
(74) *Attorney, Agent, or Firm* — Frommer Lawrence & Haug LLP; William S. Frommer; Thomas F. Presson

(57) ABSTRACT

Disclosed herein is an electric contactor including, a guide pin, and a contact, wherein the guide pin is made of a conductive material and has a head portion and a shaft portion connected to the head portion, a tip of the shaft portion connected to the head portion being smaller in diameter than the head portion, the contact is made of a conductive and elastic thin plate spring material and has first and second tubular pieces and a plurality of contact pieces, the first tubular piece being wound around the tip of the shaft portion, the second tubular piece being wound around a base end of the shaft portion located on the opposite side of the head portion, and the plurality of contact pieces configured to connect the first and second tubular pieces together.

5 Claims, 15 Drawing Sheets

ELECTRIC CONTACTOR AND ELECTRONIC EQUIPMENT

FIELD OF THE INVENTION

The present invention relates to an electric contactor and electronic equipment.

DESCRIPTION OF THE RELATED ART

Video camcorders and other electronic equipment having a detachable battery are available. This is disclosed in Japanese Patent Laid-Open No. 2005-234563.

The battery has a battery-side electric contactor configured to supply power, and the electronic equipment has an electronic equipment-side electric contactor.

As the battery is attached to the battery mounting section of the electronic equipment, the battery-side electric contactor comes in contact with the electronic equipment-side electric contactor. This permits battery power to be supplied from the battery-side electric contactor to the electronic equipment via the electronic equipment-side electric contactor.

SUMMARY OF THE INVENTION

Incidentally, recent years have seen that batteries for electronic equipment are often supplied from manufacturers other than those manufacturing the electronic equipment. As a result, the battery-side electric contactors of some batteries available on the market today have size variations.

If such a battery is attached, the battery-side and electronic equipment-side electric contactors may fail to come in stable contact with each other due to a size variation of the battery-side electric contactor, thus resulting in improper electrical contact. Alternatively, contact pieces making up the electronic equipment-side electric contactor may undergo excessive stress caused by the battery-side electric contactor, thus resulting in plastic deformation of the contact pieces and improper electrical contact.

The present invention has been made in light of the foregoing problems, and it is an embodiment of the present invention to provide an electric contactor advantageous for achieving positive electrical contact and electronic equipment having the same.

According to an embodiment of the present invention there is provided an electric contactor including:

a guide pin; and a contact, wherein the guide pin is made of a conductive material and has a head portion and a shaft portion connected to the head portion, a tip of the shaft portion connected to the head portion being smaller in diameter than the head portion, the contact is made of a conductive and elastic thin plate spring material and has first and second tubular pieces and a plurality of contact pieces, the first tubular piece being wound around the tip of the shaft portion, the second tubular piece being wound around a base end of the shaft portion located on the opposite side of the head portion, and the plurality of contact pieces configured to connect the first and second tubular pieces together, the plurality of contact pieces extend along the longitudinal direction of the shaft portion in such a manner as to be spaced from each other in the circumferential direction of the shaft portion, and a middle portion along the extension direction of each of the plurality of contact pieces is located outward in the radial direction of an outer circumferential surface of the shaft portion, the middle portion being formed as a contact portion which can move toward or away from the outer circumferential surface, one of the first and second tubular pieces is brought into electrical conduction with the shaft portion as it comes into elastic contact with or is fastened to the outer circumferential surface of the shaft portion, and the other of the first and second tubular pieces is disposed with an annular space provided between the tubular piece and the outer circumferential surface of the shaft portion.

According to another embodiment of the present invention there is provided electronic equipment including an electric contactor, having a guide pin and a contact, wherein the guide pin is made of a conductive material and has a head portion and a shaft portion connected to the head portion, a tip of the shaft portion connected to the head portion being smaller in diameter than the head portion, the contact is made of a conductive and elastic thin plate spring material and has first and second tubular pieces and a plurality of contact pieces, the first tubular piece being wound around the tip of the shaft portion, the second tubular piece being wound around a base end of the shaft portion located on the opposite side of the head portion, and the plurality of contact pieces configured to connect the first and second tubular pieces together, the plurality of contact pieces extend along the longitudinal direction of the shaft portion in such a manner as to be spaced from each other in the circumferential direction of the shaft portion, and a middle portion along the extension direction of each of the plurality of contact pieces is located outward in the radial direction of an outer circumferential surface of the shaft portion, the middle portion being formed as a contact portion which can move toward or away from the outer circumferential surface, one of the first and second tubular pieces is brought into electrical conduction with the shaft portion as it comes into elastic contact with or is fastened to the outer circumferential surface of the shaft portion, and the other of the first and second tubular pieces is disposed with an annular space provided between the tubular piece and the outer circumferential surface of the shaft portion.

One of the first and second tubular pieces is brought into electrical conduction with the shaft portion as it comes into elastic contact with or is fastened to the outer circumferential surface of the shaft portion. The other of the first and second tubular pieces is disposed with an annular space provided between the tubular piece and the outer circumferential surface of the shaft portion. This keeps the contact pieces of the contact free from excessive stress, thus avoiding plastic deformation of the contact pieces. This makes the present invention advantageous for achieving positive electrical contact.

DETAILED DESCRIPTION OF THE PREFERRED EMBODIMENTS

A description will be given next of the preferred embodiments of the present invention with reference to the accompanying drawings.

Figure 1:
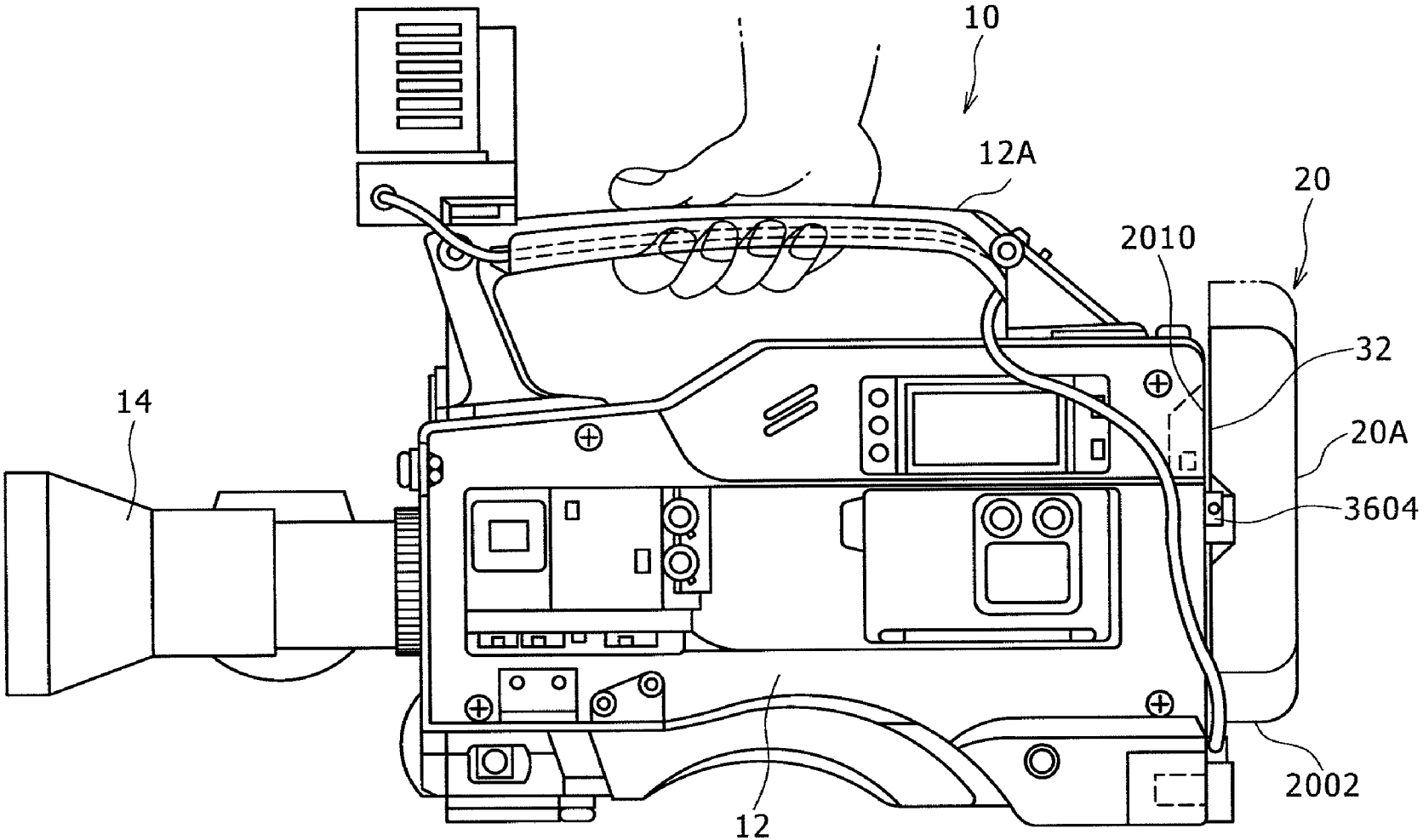
FIG. 1 is a side view of an imaging device according to an embodiment of the present embodiment.
Figure 2:
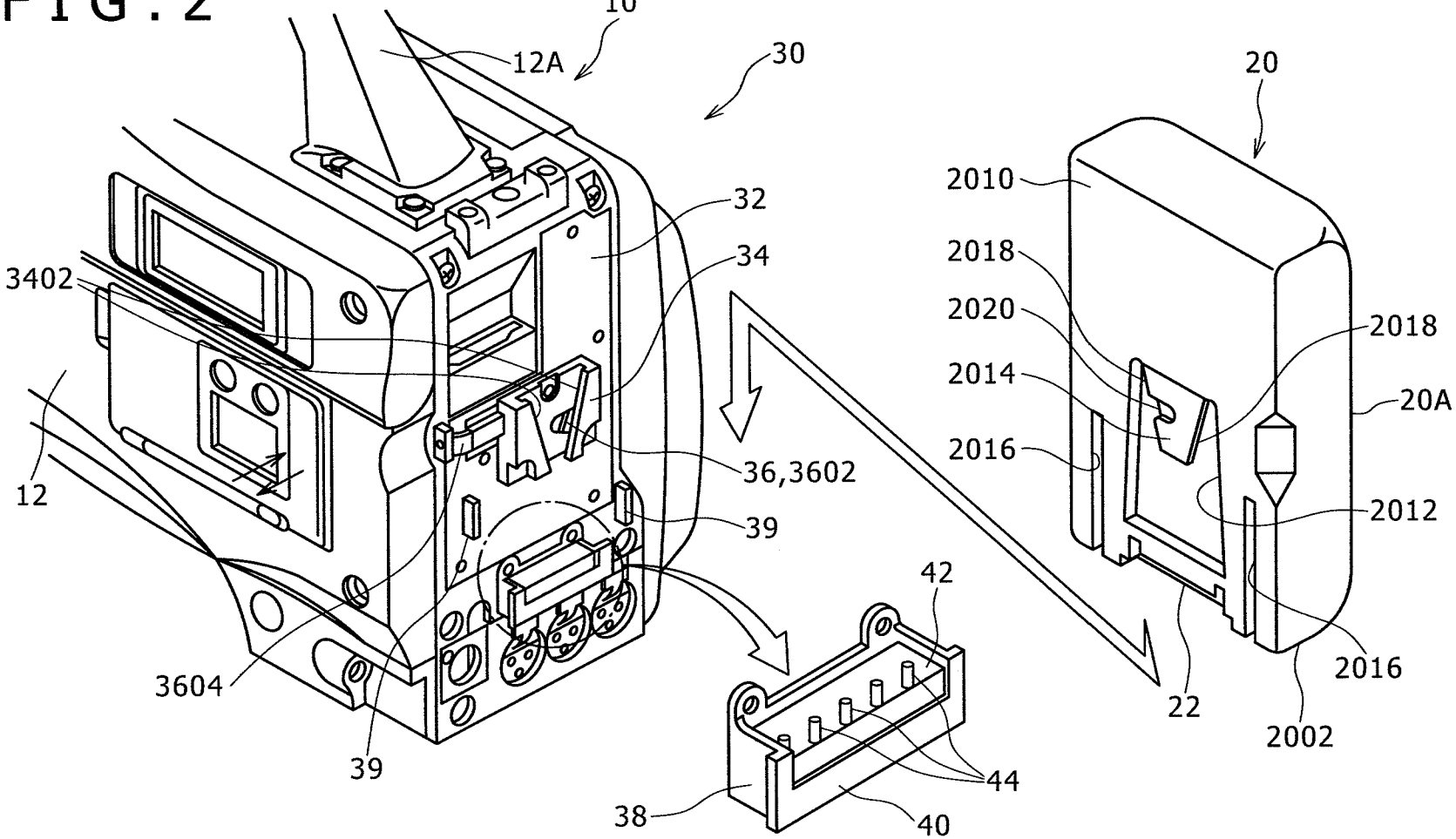
FIG. 2 is an explanatory view for describing the attachment and detachment of a battery to and from the imaging device.

FIG. 1 is a side view of an imaging device 10 according to the present embodiment. FIG. 2 is an explanatory view for describing the attachment and detachment of a battery 20 to and from the imaging device 10. As illustrated in FIG. 1, the electronic equipment in the present embodiment is the imaging device (video camcorder) 10 for business use as used in broadcasting stations. The battery 20 is attached to the imaging device 10 in an attachable/detachable manner.

As illustrated in FIG. 1, the imaging device 10 includes a camera body 12 which extends toward the front and rear of the imaging device 10.

It should be noted that the left and right sides of the imaging device 10 are as seen from the rear of the imaging device 10. It should also be noted that the subject side along the optical axis of the imaging optical system is the front side, and that the imaging element side is the rear side thereof.

A handle 12A is provided on the top surface of the camera body 12 to carry the imaging device 10.

A lens barrel 14 is mounted to the front portion of the camera body 12.

The lens barrel 14 accommodates the imaging optical system which is not shown.

An imaging element, a signal processing section, a recording/reproduction section and other sections which are not shown are provided in the camera body 12.

The imaging element is designed to capture the subject image guided by the imaging optical system. A (Charge Coupled Device) sensor, (Complementary Metal Oxide Semiconductor) sensor or any of various other publicly known imaging elements may be used as the imaging element.

As illustrated in FIGS. 1 and 2, the battery 20 has a case 20A in the form of a rectangular plate which accommodates an unshown cell.

The case 20A has a thickness, a width greater than the thickness thereof and a length greater than the width thereof.

A battery-side connector 22 is provided on an end surface 2002 located on one end along the length of the case 20A. The battery-side connector 22 supplies power from the cell to the imaging device 10.

Figure 7:
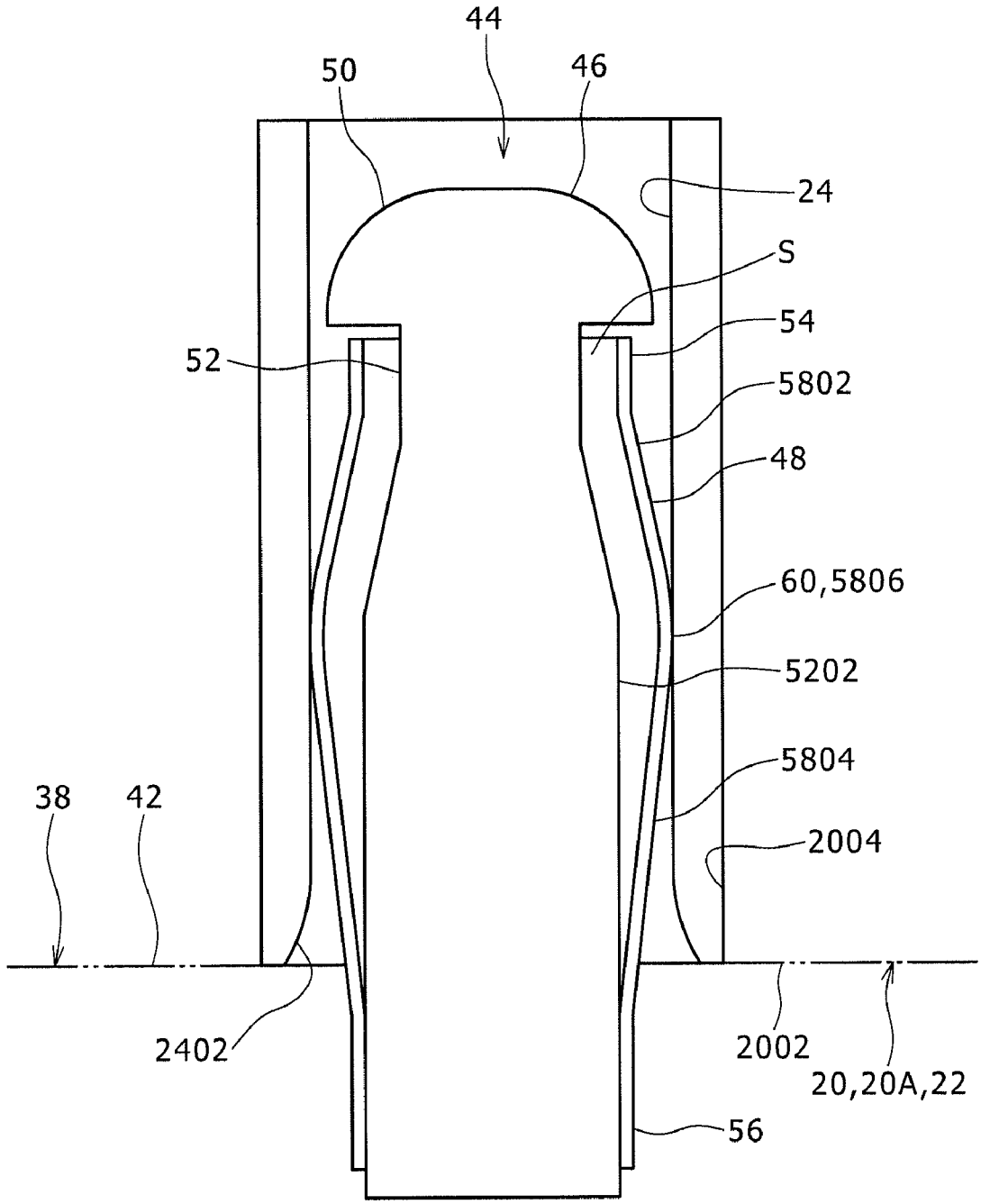
FIG. 7 is a first sectional view illustrating the electronic equipment-side electric contactor according to the embodiment inserted in a battery-side electric contactor.

As illustrated in FIG. 7, the battery-side connector 22 includes a plurality of battery-side electric contactors 24.

That is, the end surface 2002 has a plurality of holes 2004, each of which is outwardly open at one end. The holes 2004 are located at the same position along the thickness of the end surface 2002 and spaced apart from each other along the width of the same surface 2002.

One of the battery-side electric contactors 24 is inserted into each of the holes 2004.

The battery-side electric contactors 24 are each fabricated by forming a thin metal plate into a cylindrical shape. The battery-side electric contactors 24 are formed with an inner diameter to permit attachment and detachment of an electronic equipment-side electric contactor 44 which will be described later.

As illustrated in FIGS. 1 and 2, the surface on one end along the thickness of the battery 20 is formed as a mounting surface 2010 which extends in the same plane.

A concave portion 2012, a battery-side engagement section 2014 and two guide grooves 2016 are provided on the mounting surface 2010, as illustrated in FIG. 2.

The concave portion 2012 is provided at the center along the width of the mounting surface 2010 and close to the battery-side connector 22. The concave portion 2012 extends along the length of the case 20A.

The battery-side engagement section 2014 includes a dovetail 2018. The dovetail 2018 includes a pair of slopes with a gradually decreasing width toward the battery-side connector 22.

An engagement concave portion 2020 is formed on one of the pair of slopes. A locking hook 3602 which will be described later engages with the engagement concave portion 2020.

The two guide grooves 2016 are formed to extend in parallel along the length of the case 20A with the concave portion 2012 provided between the outer sides thereof along the width.

One end of each of the guide grooves 2016 is located on each side of a middle portion of the concave portion 2012 along the extension direction thereof, and the other end is opened toward the end surface 2002.

As illustrated in FIG. 2, a battery mounting section 30 is provided on the rear surface of the camera body 12. The battery 20 is attached to the battery mounting section 30.

The battery mounting section 30 includes a mounting surface 32, an electronic equipment-side engagement section 34, a locking mechanism 36, an electronic equipment-side connector 38, guide pieces 39 and other parts.

The mounting surface 32 extends in the same plane as that running in the vertical and horizontal directions of the camera body 12.

The electronic equipment-side engagement section 34 is formed to swell out from the vertical and horizontal center of the mounting surface 32.

The electronic equipment-side engagement section 34 comes into and out of engagement with the battery-side engagement section 2014.

The electronic equipment-side engagement section 34 includes a dovetail groove 3402 configured to engage with the dovetail 2018 in an engageable and disengageable manner.

The dovetail groove 3402 includes a pair of slopes opposed to each other, the distance between which gradually decreases toward the bottom (electronic equipment-side connector 38).

The locking mechanism 36 includes the locking hook 3602 and an unlocking member 3604.

The locking hook 3602 is biased at all times in the direction from one of the slopes of the dovetail groove 3402 to the inside of the dovetail groove 3402.

The unlocking member 3604 is configured in such a manner as to sink the locking hook 3602 from inside the dovetail groove 3402 through the slope into the slope as the unlocking member 3604 is operated.

The two guide pieces 39 are provided, one on the left and another on the right of the mounting surface 32.

The guide pieces 39 engage with the guide grooves 2016 of the battery 20 when the battery 20 is attached to the battery mounting section 30 so as to guide the travel of the battery 20 in the engaging or disengaging direction.

The electronic equipment-side connector 38 is provided on the rear surface of the camera body 12 and at a position downward of the mounting surface 32.

The electronic equipment-side connector 38 includes a connector main body 40, sliding shutter 42 and electronic equipment-side electric contactors 44. The present invention is applied to the electronic equipment-side electric contactors 44.

The connector main body 40 holds the electronic equipment-side electric contactors 44 and is attached to the camera body 12, for example, with screws.

The sliding shutter 42 is provided in the connector main body 40 to be slidable between closing and exposing positions shown in FIGS. 2 and 7. The sliding shutter 42 covers and exposes the electronic equipment-side electric contactors 44 respectively when located at the closing and exposing positions. The sliding shutter 42 is biased to remain at the closing position.

Although the configuration of the electronic equipment-side electric contactors 44 will be described in detail later, the electronic equipment-side electric contactors 44 are formed in a size which can be inserted into the inner circumferences of the battery-side electric contactors 24. The two contactors come into electric contact with each other as the electronic equipment-side electric contactors 44 are inserted into the inner circumferences of the battery-side electric contactors 24.

In order to attach the battery 20 to the battery mounting section 30, the mounting surface 2010 of the battery 20 is placed against the mounting surface 32 of the battery mounting section 30 while at the same time bringing the battery-side section 2014 face-to-face with the electronic equipment-side engagement section 34.

Then, as the battery 20 is moved downward, the area of the battery-side connector 22 presses the sliding shutter 42 against the biasing force, sliding the sliding shutter 42 to the exposing position and inserting the electronic equipment-side electric contactors 44 into the battery-side electric contactors 24 for conduction.

As the battery 20 is moved further downward, the dovetail 2018 of the battery-side section 2014 engages with the dovetail groove 3402 of the electronic equipment-side engagement section 34, stopping the battery 20 from moving further downward.

At this time, the locking hook 3602 of the battery mounting section 30 engages with the engagement concave portion 2020 of the battery 20, preventing the battery 20 from falling off the battery mounting section 30.

In order to detach the battery 20 from the battery mounting section 30, the unlocking member 3604 is operated. This disengages the locking hook 3602 from the engagement concave portion 2020 of the battery 20. The battery 20 is moved upward in this condition.

As the battery 20 is moved upward, the dovetail 2018 of the battery-side section 2014 is detached from the dovetail groove 3402 of the electronic equipment-side engagement section 34. At the same time, the electronic equipment-side electric contactors 44 are pulled out of the battery-side electric contactors 24. This detaches the battery 20 from the battery mounting section 30.

As a result of the removal of the battery 20, the sliding shutter 42 returns from the exposing position to the closing position, thus covering the electronic equipment-side electric contactors 44.

The electronic equipment-side electric contactor 44 will be described next.

Figure 3:
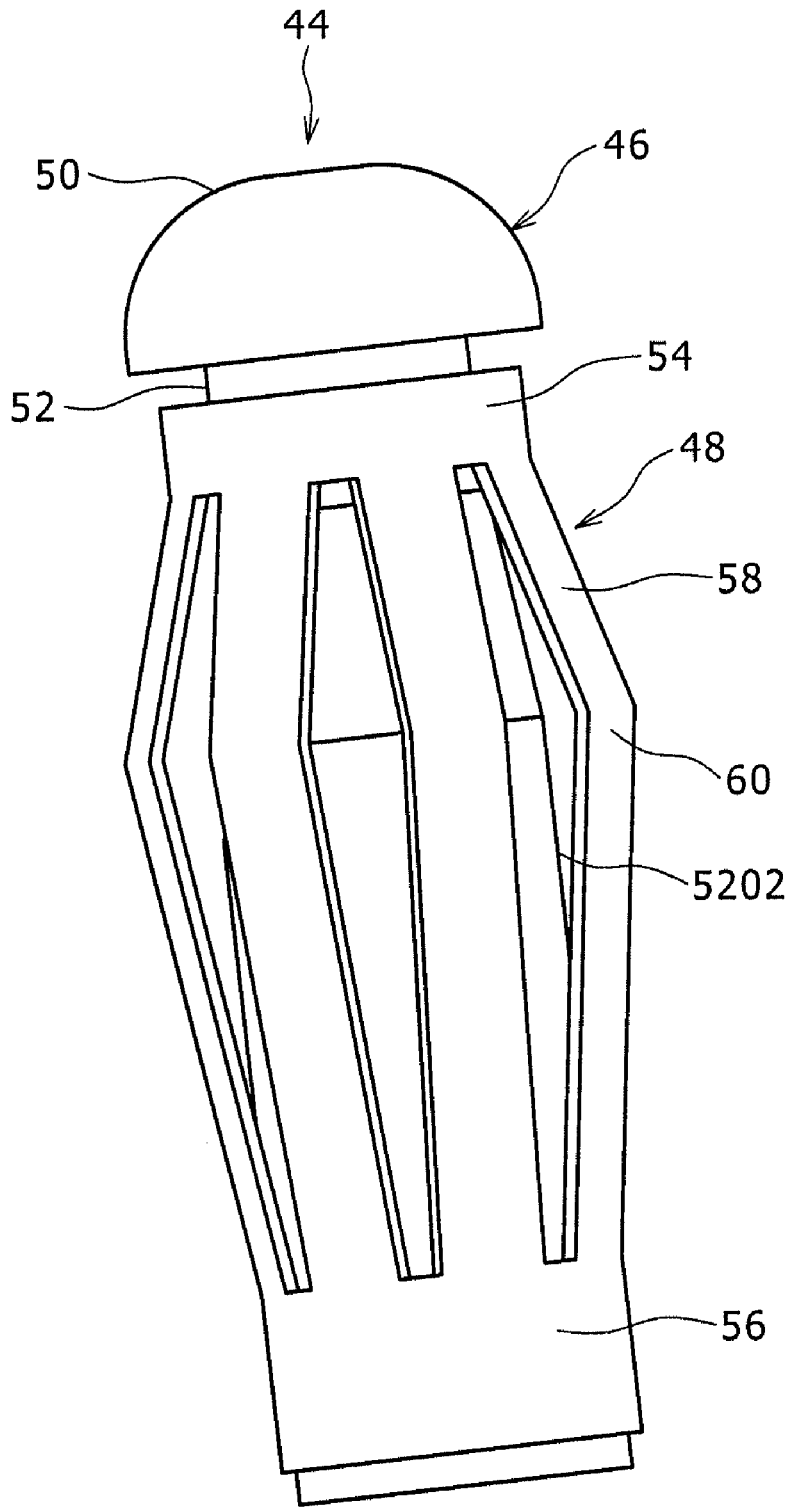
FIG. 3 is a perspective view of an electronic equipment-side electric contactor.
Figure 4:
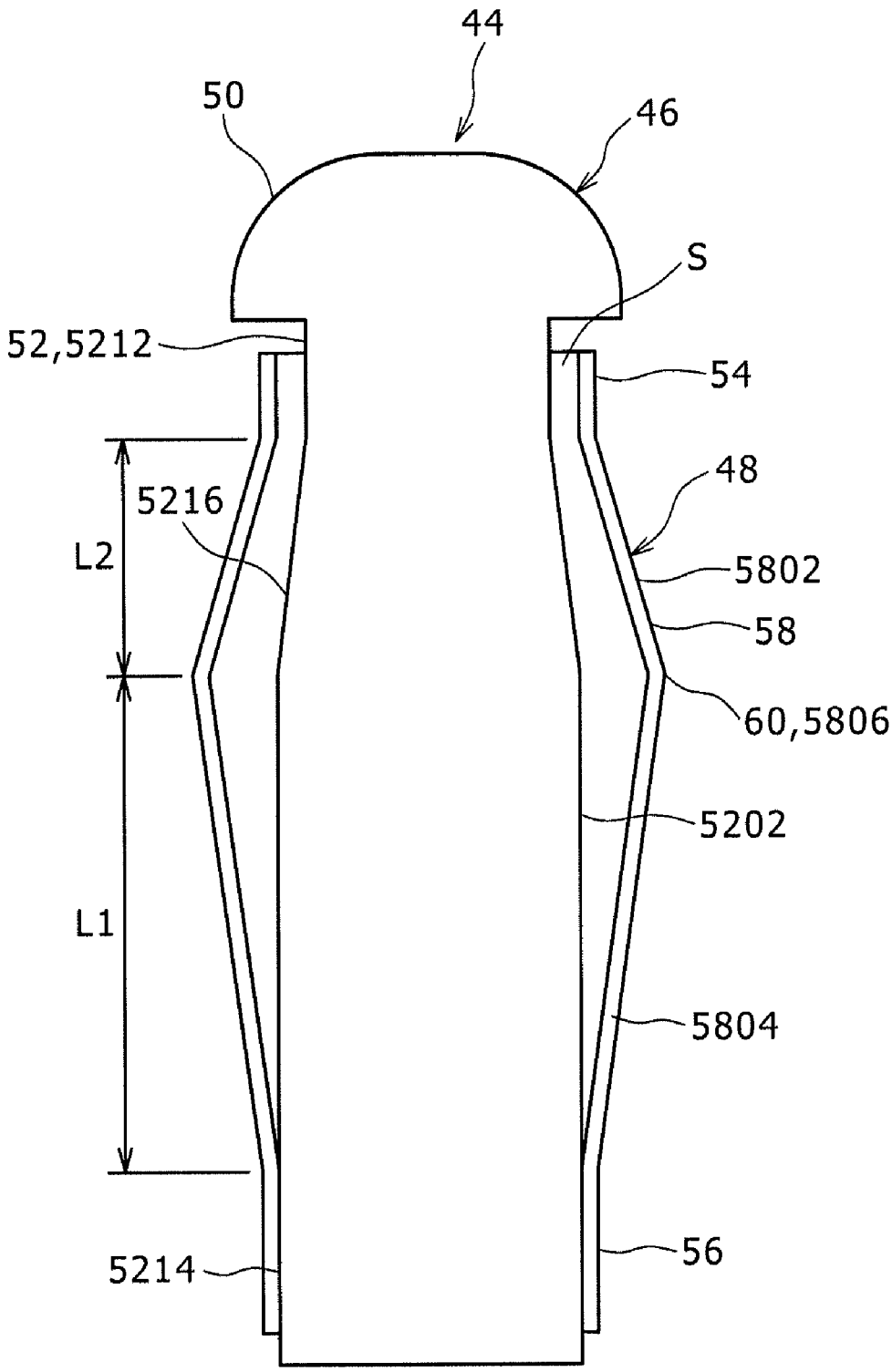
FIG. 4 is a sectional view of the electronic equipment-side electric contactor.
Figure 5:
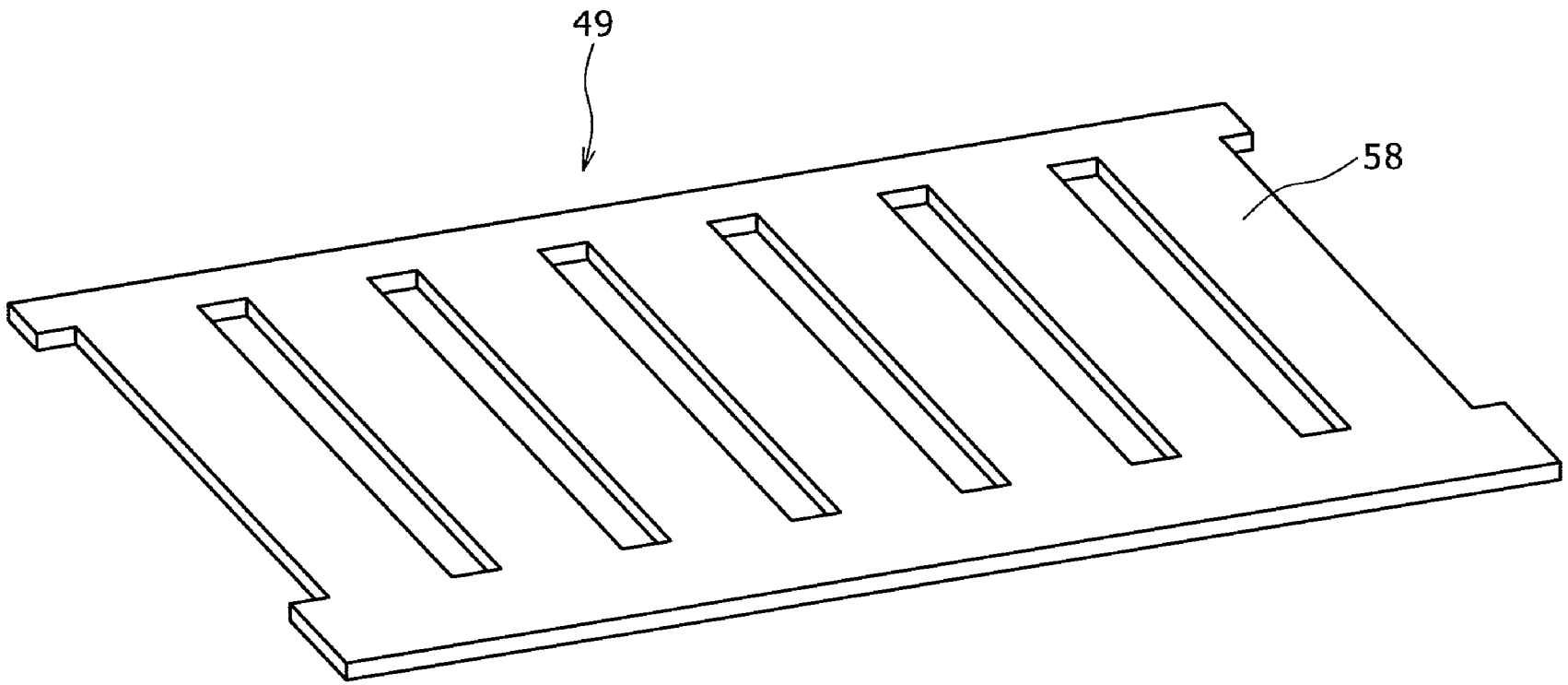
FIG. 5 is a perspective view of a spring material making up a contact.
Figure 6:
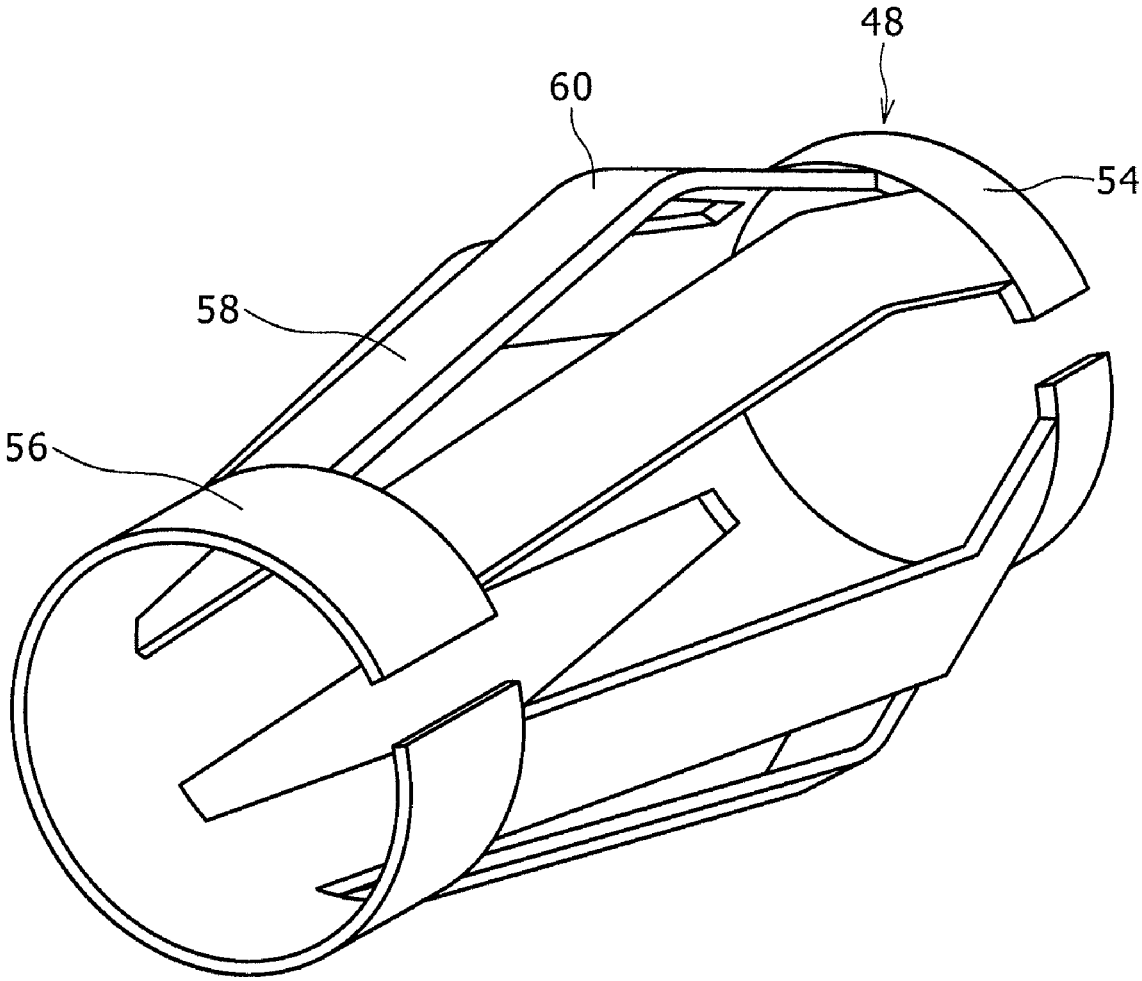
FIG. 6 is a perspective view of the contact.

FIG. 3 is a perspective view of the electronic equipment-side electric contactor 44. FIG. 4 is a sectional view thereof. FIG. 5 is a perspective view of a spring material 49 making up a contact 48. FIG. 6 is a perspective view of the contact 48.

As illustrated in FIGS. 3 and 4, the electronic equipment-side electric contactor 44 includes a guide pin 46 and the contact 48.

The guide pin 46 is made of a conductive material and includes a head portion 50 and a shaft portion 52 connected to the head portion 50.

Any of various publicly known conventional materials such as phosphor bronze may be used as the conductive material of the guide pin 46.

As illustrated in FIG. 4, a tip 5212 of the shaft portion 52 connected to the head portion 50 is formed with a cylindrical surface having a uniform diameter smaller than the diameter of the head portion 50.

On the other hand, a base end 5214 of the shaft portion located on the opposite side of the head portion 50 is formed with a cylindrical surface having a uniform diameter larger than the diameter of the tip 5212 and smaller than the diameter of the head portion 50.

The cylindrical surface of the base end 5214 extends to the mid portion of the guide pin 46 along the extension direction.

A conical surface portion 5216 is formed with a conical surface having a gradually increasing outer diameter from the edge of the tip 5212 to the base end 5214. The conical surface portion 5216 is connected to the cylindrical surface of the base end 5214 at the middle portion along the extension direction of the guide pin 46.

It should be noted that the portion where the conical surface portion 5216 is connected to the cylindrical surface of the base end 5214 is associated with a summit portion 5806 of the angle of the contact 48.

The contact 48 is made of a conductive and elastic thin plate spring material 49 as illustrated in FIG. 5.

Any of various publicly known conventional materials such as beryllium copper and phosphor bronze may be used as the spring material 49 of the contact 48.

The contact 48 includes first and second tubular pieces 54 and 56 and a plurality of contact pieces 58. The first tubular piece 54 is wound around the tip 5212 of the shaft portion 52. The second tubular piece is wound around the base end 5214 of the shaft portion 52 located on the opposite side of the head portion 50 as illustrated in FIG. 6. The plurality of contact pieces 58 connect the first and second tubular pieces 54 and 56 together. As illustrated in FIGS. 3 and 4, the plurality of contact pieces 58 extend along the longitudinal direction of the shaft portion 52 in such a manner as to be spaced from each other in the circumferential direction of the shaft portion 52. A middle portion along the extension direction of each of the plurality of contact pieces 58 is located outward in the radial direction of an outer circumferential surface 5202 of the shaft portion 52. The middle portion is formed as a contact portion 60 which can move toward or away from the outer circumferential surface 5202.

As illustrated in FIGS. 3 and 4, the first tubular piece 54 is formed smaller in diameter than the head portion 50 when wound around the tip of the shaft portion 52.

One of the first and second tubular pieces 54 and 56 is brought into electrical conduction with the shaft portion 52 as it comes into elastic contact with or is fastened to the outer circumferential surface 5202 of the shaft portion 52. In the present embodiment, the second tubular piece 56 electrically conducts to the shaft portion 52.

It should be noted that one of the first and second tubular pieces 54 and 56 is fastened to the outer circumferential surface 5202 of the shaft portion 52, for example, by welding. Such fastening of either of the first and second tubular pieces 54 and 56 to the shaft portion 52 is more preferred in order to achieve positive electrical connection between the contact 48 and guide pin 46.

As illustrated in FIG. 4, the other of the first and second tubular pieces 54 and 56 is disposed with an annular space S provided between the tubular piece and the outer circumferential surface 5202 of the shaft portion 52. In the present embodiment, the first tubular piece 54 is disposed with the annular space S provided between the tubular piece 54 and the outer circumferential surface 5202 of the shaft portion 52.

As illustrated in FIG. 4, each of the plurality of contact pieces 58 has first and second sloping pieces 5802 and 5804 and the summit portion 5806 configured to connect the first and second sloping pieces 5802 and 5804. The contact portion 60 includes the summit portion 5806.

That is, the first sloping piece 5802 extends from the first tubular piece 54 to the second tubular piece 56 while at the same time distancing itself further from the outer circumferential surface 5202 of the shaft portion 52.

On the other hand, the second sloping piece 5804 extends from the second tubular piece 56 to the first tubular piece 54 while at the same time distancing itself further from the outer circumferential surface 5202 of the shaft portion 52.

Then, the summit portion 5806 connects the first and second sloping piece 5802 and 5804 and is bent in the form of an angle.

That is, a middle portion along the extension direction of each of the plurality of contact pieces 58 is located more outward in the radial direction of the outer circumferential surface 5202 of the shaft portion 52 than the first and second tubular pieces 54 and 56.

When the distance from the second tubular piece 56 to the summit portion 5806 of the angle is denoted by L1 and that from the first tubular piece 54 to the summit portion 5806 of the angle by L2, the relationships $L1>L2$ and $L2<(L1+L2)/2$ are satisfied.

The above configuration permits the contact portion 60 to be located more toward the back of the battery-side electric contactors 24 when the electronic equipment-side electric contactor 44 is inserted into the battery-side electric contactors 24. In other words, this prevents improper contact as a result of the contact portion 60 remaining near an opening 2402 (FIG. 7) of the tubular battery-side electric contactors 24.

The operation and effects of the present invention will be described next.

Figure 8:
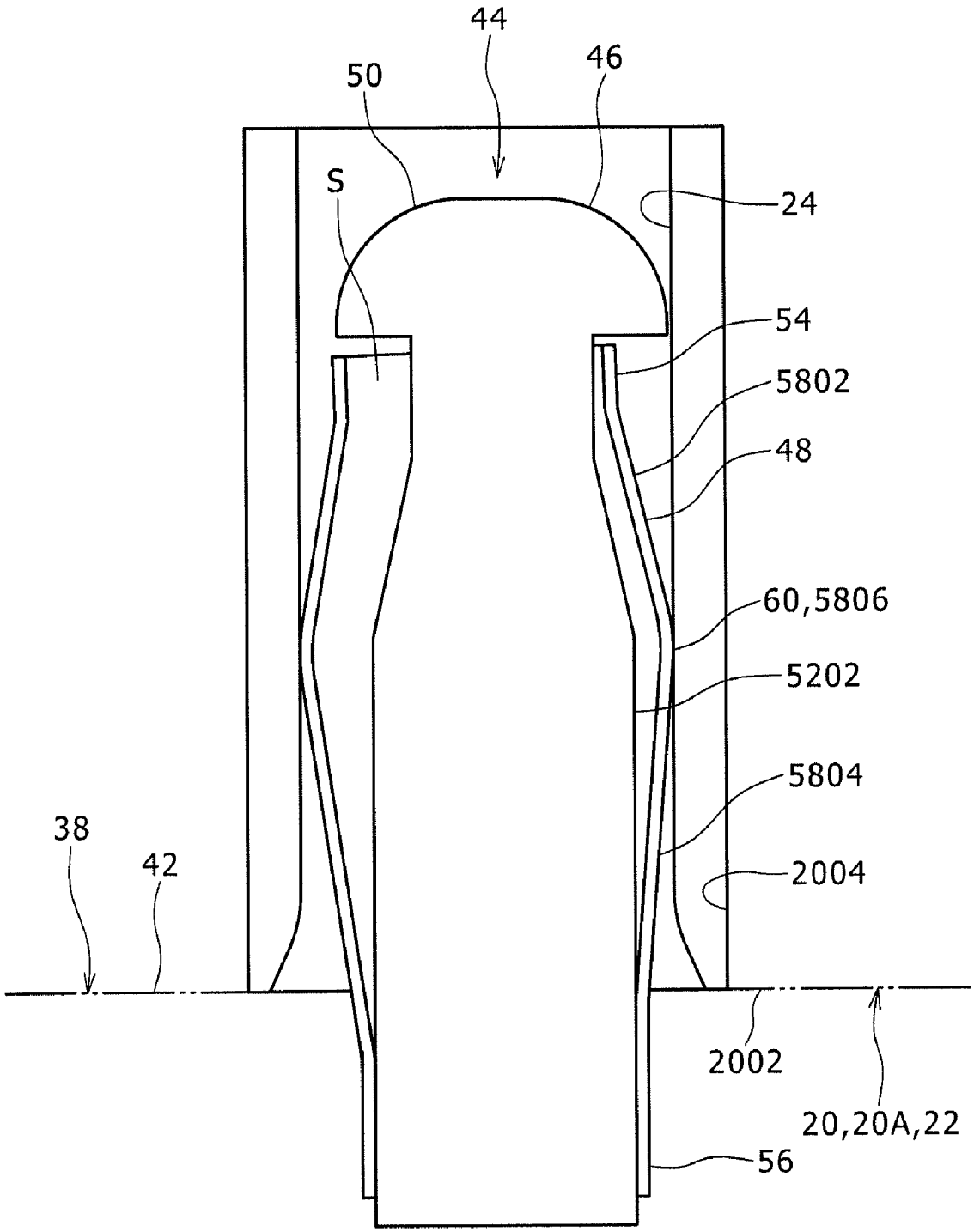
FIG. 8 is a second sectional view illustrating the electronic equipment-side electric contactor according to the embodiment inserted in the battery-side electric contactor.

FIGS. 7 and 8 are first and second sectional views illustrating the electronic equipment-side electric contactor 44 according to the embodiment inserted in the battery-side electric contactor 24.

A description will be given first of a case in which the electronic equipment-side electric contactor 44 is inserted into the battery-side electric contactor 24 with the center axes thereof aligned with each other as illustrated in FIG. 7.

In this case, the entire circumference of the contact portion 60 of the contact 48 comes into elastic contact with the entire inner circumferential surface of the battery-side electric contactor 24. This permits positive electrical contact between the contact 48 and battery-side electric contactor 24, thus ensuring electrical connection between the electronic equipment-side electric contactor 44 and battery-side electric contactor 24.

A description will be given next of a case in which the electronic equipment-side electric contactor 44 is inserted into the battery-side electric contactor 24 with the center axes thereof not aligned with each other as illustrated in FIG. 8.

In this case, the contact portions 60 of the plurality of contact pieces 58 of the contact 48 come into elastic contact with the inner circumferential surface of the battery-side electric contactor 24, thus forming a plurality of contact points between the contact 48 and battery-side electric contactor 24. This permits positive electrical contact between the contact 48 and battery-side electric contactor 24, thus ensuring electrical connection between the electronic equipment-side electric contactor 44 and battery-side electric contactor 24.

Here, the annular space S is provided between the first tubular piece 54 and the outer circumferential surface 5202 of the shaft portion 52. As a result, the contact 48 tilts in response to the pressing force applied by the battery-side electric contactor 24. This ensures that no excessive stress is produced on any of the contact pieces 58 of the contact 48, thus avoiding plastic deformation (loss of resilience) of the contact pieces 58 which could lead to loss of elasticity of the contact pieces 58.

This maintains the contact pieces 58 and battery-side electric contactor 24 in contact with each other at all times with a proper pressing force. This is advantageous in that this achieves positive electrical contact between the electronic equipment-side electric contactor 44 and battery-side electric contactor 24.

A description will be given next of the comparison with a comparative example.

Figure 12:
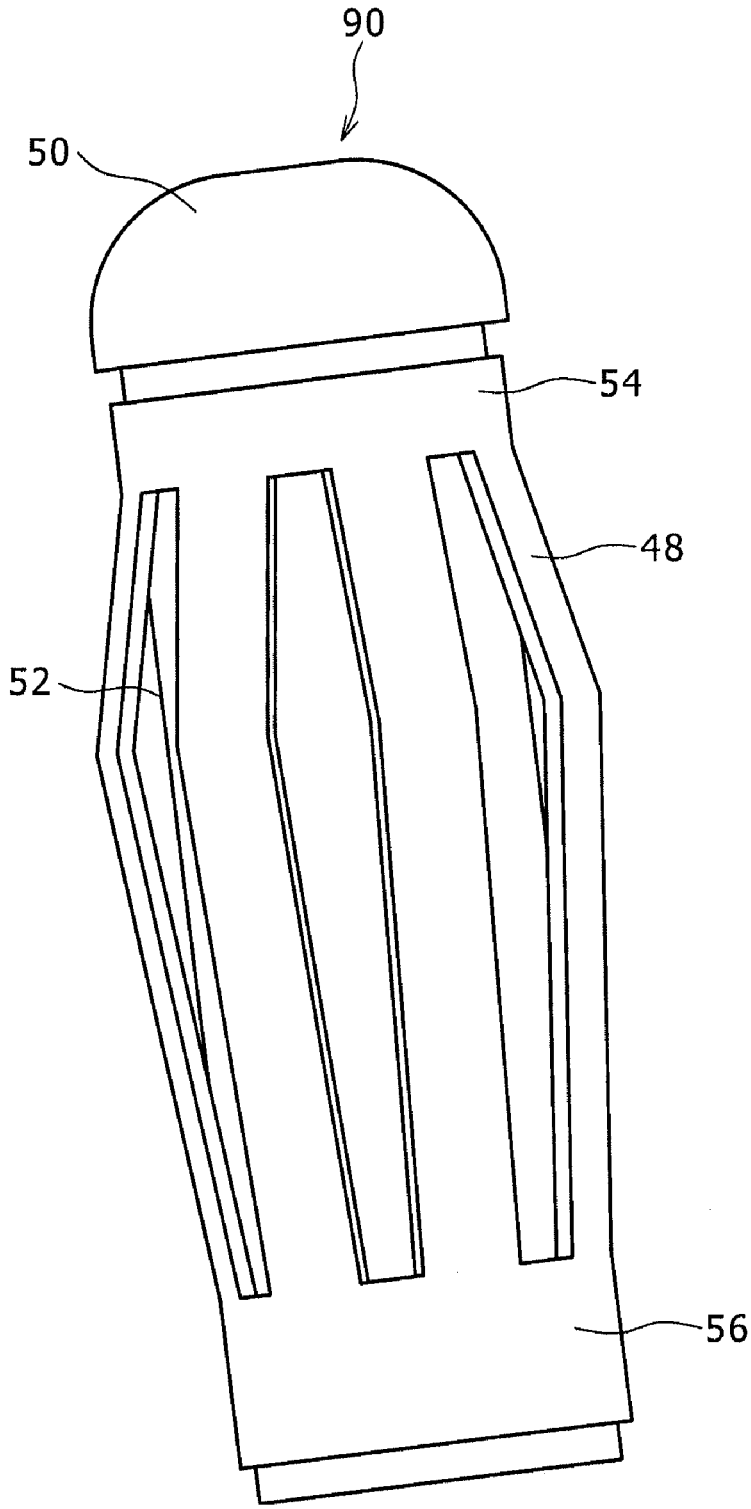
FIG. 12 is a perspective view of the electronic equipment-side electric contactor as a comparative example.
Figure 13:
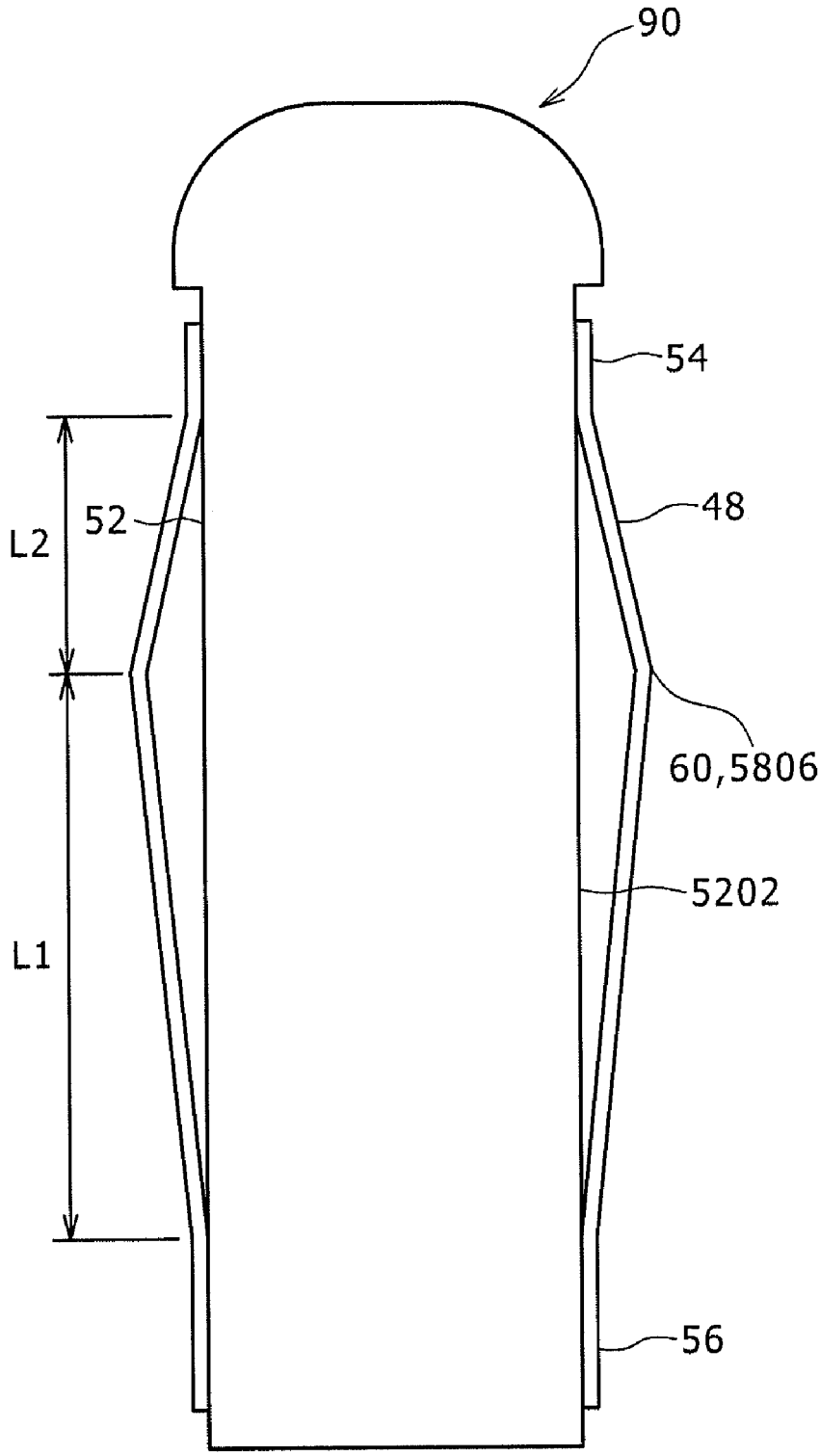
FIG. 13 is a sectional view of the electronic equipment-side electric contactor as a comparative example.

FIGS. 12 and 13 are a perspective view and sectional view, respectively, of an electronic equipment-side electric contactor 90 as a comparative example.

Figure 14:
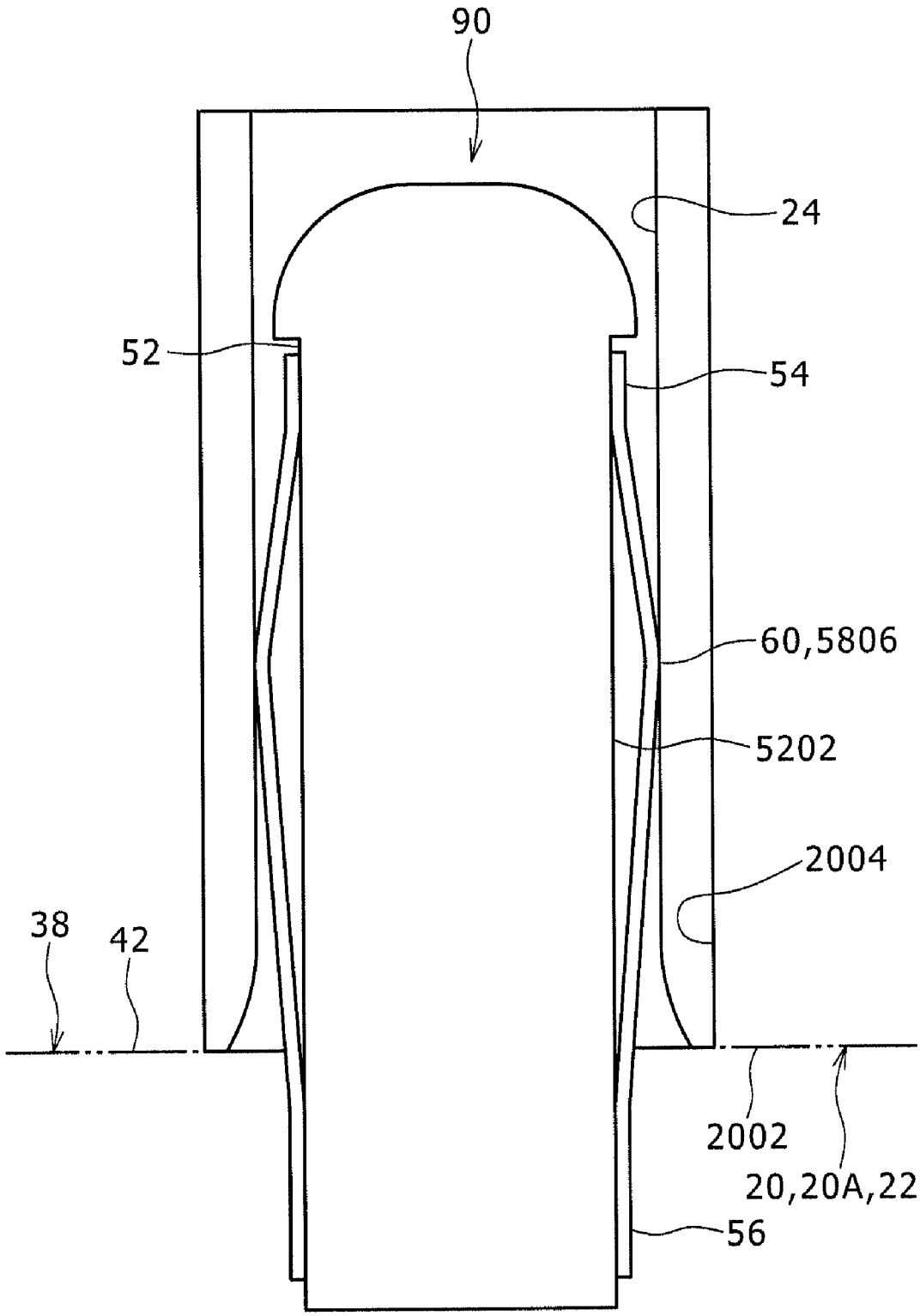
FIG. 14 is a first sectional view illustrating the electronic equipment-side electric contactor as a comparative example inserted in the battery-side electric contactor.
Figure 15:
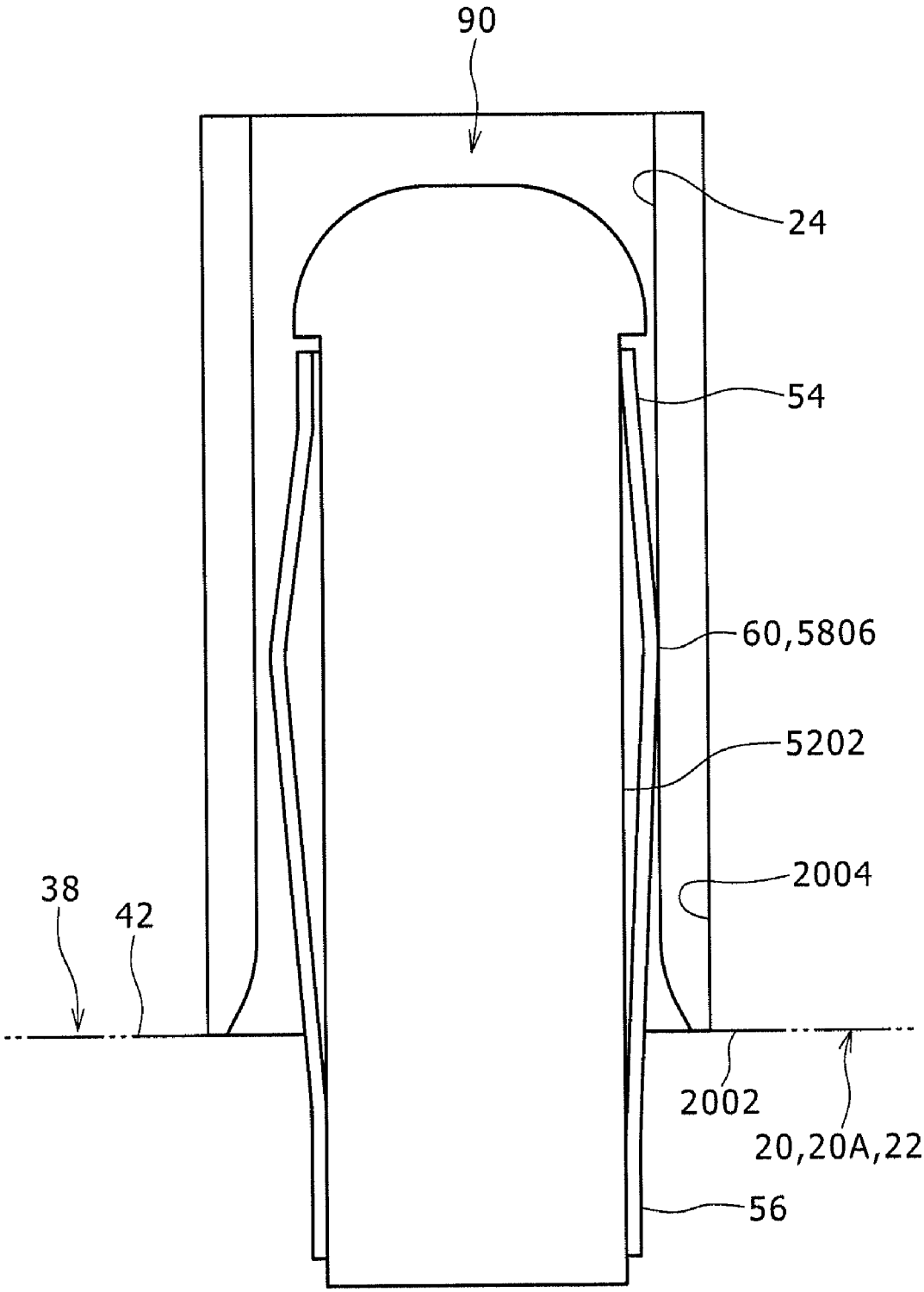
FIG. 15 is a second sectional view illustrating the electronic equipment-side electric contactor as a comparative example inserted in the battery-side electric contactor.

FIGS. 14 and 15 are first and second sectional views illustrating the electronic equipment-side electric contactor 90 as a comparative example inserted in the battery-side electric contactor 24.

It should be noted that like components and members as those in the first embodiment are denoted by like reference numerals and the description thereof will be omitted.

As illustrated in FIGS. 12 and 13, the electronic equipment-side electric contactor 90 as a comparative example electrically conducts to the shaft portion 52 as a result of elastic contact of both of the first and second tubular pieces 54 and 56 with the outer circumferential surface 5202 of the shaft portion 52.

First, when the electronic equipment-side electric contactor 90 is inserted into the battery-side electric contactor 24 with the center axes thereof aligned with each other as illustrated in FIG. 14, the contact portions 60 of the plurality of contact pieces 58 of the contact 48 come into elastic contact with the inner circumferential surface of the battery-side electric contactor 24, electrically connecting the electronic equipment-side electric contactor 90 and battery-side electric contactor 24 together.

In this electronic equipment-side electric contactor 90 of the past, however, the slope of the spring characteristic is large as described later. In the presence of a variation in inner diameter of the battery-side electric contactor 24, therefore, the contact force between the contact 48 and battery-side electric contactor 24 changes significantly. As a result, the art of the past is disadvantageous for maintaining the contact force stable.

On the other hand, when the electronic equipment-side electric contactor 90 is inserted into the battery-side electric contactor 24 with the center axes thereof not aligned with each other as illustrated in FIG. 15, the following inconvenience will occur.

That is, the battery-side electric contactor 24 strongly presses, in the diametric direction thereof, the contact portions 60 of the contact 48 on the side in proximity to the battery-side electric contactor 24. The battery-side electric contactor 24 weakly presses, in the diametric direction thereof, the contact portions 60 of the contact 48 on the side apart from the battery-side electric contactor 24.

This produces excessive stress on some of the contact pieces 58 of the contact 48 that are strongly pressed, resulting in plastic deformation (loss of resilience) of the contact pieces 58.

The contact pieces 58 of the contact 48 may undergo plastic deformation as a result of the attachment and detachment of the battery a number of times in the presence of part-to-part variation and variation in the manner of attachment and detachment of the battery. Plastic deformation of the contact pieces 58 leads to reduced diameter of the contact portions 60 of the contact 48.

This prevents the contact pieces 58 and battery-side electric contactor 24 from coming in contact with each other with a proper pressing force. This makes the comparative example disadvantageous for achieving positive electrical contact between the electronic equipment-side electric contactor 90 and battery-side electric contactor 24.

Figure 9:
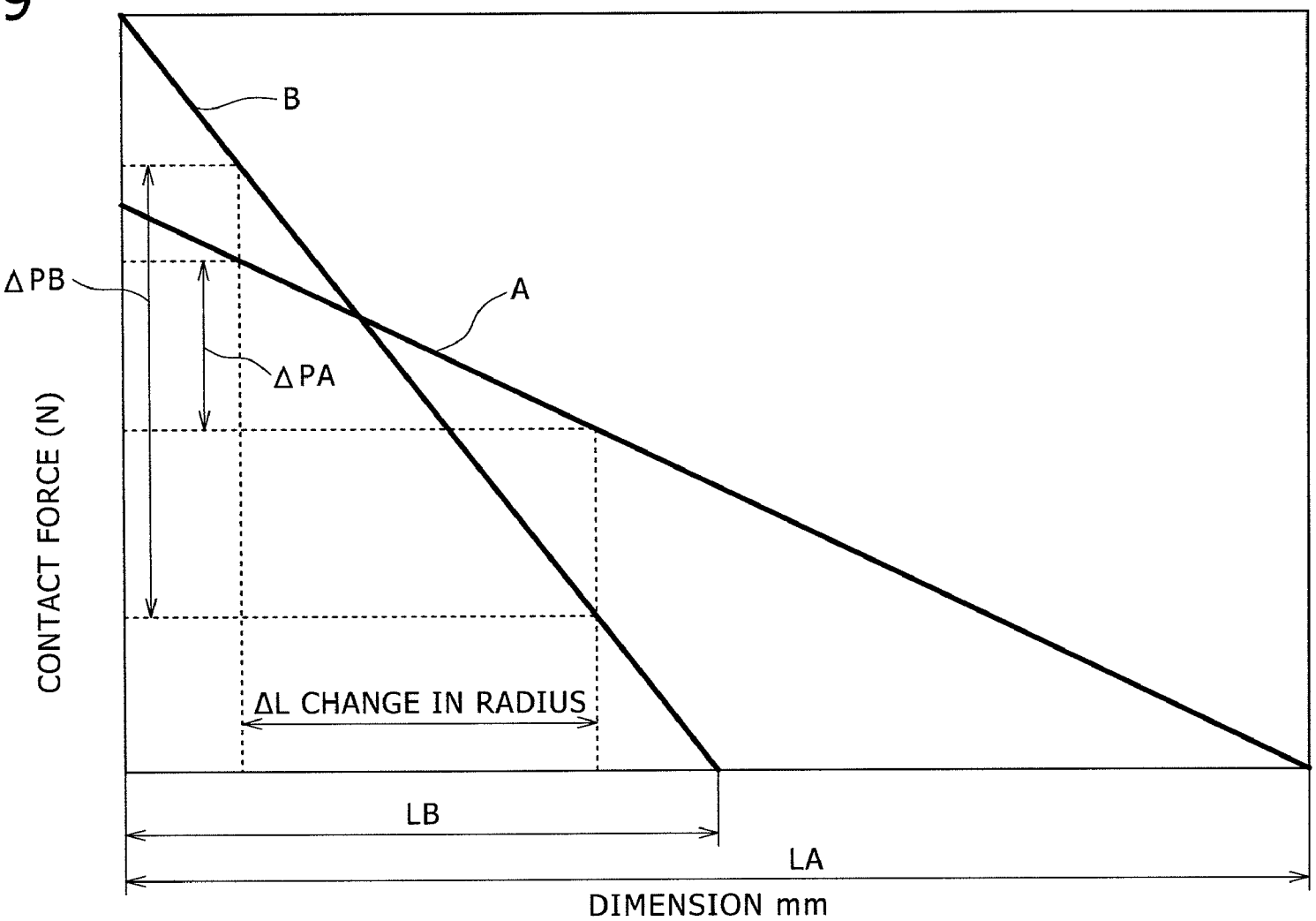
FIG. 9 is a chart illustrating the spring characteristics of the contact of the electronic equipment-side electric contactor according to the embodiment and that of an electronic equipment-side electric contactor as a comparative example.

FIG. 9 is a chart illustrating the spring characteristics of the contact 48 of the electronic equipment-side electric contactor 44 according to the embodiment and that of the electronic equipment-side electric contactor 90 as a comparative example.

In FIG. 9, the horizontal axis represents the displacement of the contact portions 60 of the contact 48 along the diameter thereof, and the vertical axis the contact force produced on the contact portions 60 of the contact 48.

A solid line A represents the spring characteristic of the contact 48 of the electronic equipment-side electric contactor 44 according to the embodiment, and a solid line B that of the electronic equipment-side electric contactor 90 as a comparative example.

An elastic deformation range LA of the contact 48 according to the embodiment is larger than an elastic deformation range LB of the contact 48 as a comparative example.

Further, the solid line A has a larger slope of the spring characteristic than the solid line B.

The reason for this is as follows. That is, the contact 48 as a comparative example satisfies the relationships L1>L2 and L2<(L1+L2)/2 when the distance from the second tubular piece 56 to the summit portion 5806 of the angle is denoted by L1, and that from the first tubular piece 54 to the summit portion 5806 of the angle by L2. Further, unlike the present invention, both of the first and second tubular pieces 54 and 56 are in elastic contact with the outer circumferential surface 5202 of the shaft portion 52. As a result, the impact of elasticity of the area of the contact pieces 58 corresponding to the distance L2 shorter than the distance L1 manifests itself.

Therefore, when the electronic equipment-side electric contactor 90 is inserted into the battery-side electric contactor 24, the reduction in diameter of the contact portions 60 of the contact 48 of the electronic equipment-side electric contactor 90 will change due to variation in inner diameter of the battery-side electric contactor 24.

By comparison between a change ΔPB in a contact force N of the contact 48 as a comparative example for the above change in diameter reduction and a change ΔPA in the contact force N of the contact 48 according to the embodiment, it is found that ΔPB>ΔPA. The contact 48 according to the embodiment has a smaller change in the contact force N, making it advantageous for achieving stable electrical contact between the contact 48 and battery-side electric contactor 24.

As described above, according to the present embodiment, one of the first and second tubular pieces 54 and 56 is brought into electrical conduction with the shaft portion 52 as it comes into elastic contact with or is fastened to the outer circumferential surface 5202 of the shaft portion 52. The other of the first and second tubular pieces 54 and 56 is disposed with the annular space S provided between the tubular piece and the outer circumferential surface 5202 of the shaft portion 52.

This keeps the contact pieces 58 of the contact 48 free from excessive stress, thus avoiding plastic deformation (loss of resilience) of the contact pieces 58. This makes it advantageous for achieving positive electrical contact between the electronic equipment-side electric contactor 44 and battery-side electric contactor 24.

It should be noted that although, in the present embodiment, the relationships L1>L2 and L2<(L1+L2)/2 are satisfied when the distance from the second tubular piece 56 to the summit portion 5806 of the angle is denoted by L1 and that from the first tubular piece 54 to the summit portion 5806 of the angle by L2, the relationship to be satisfied may be, for example, L1=L2.

However, the present embodiment prevents improper contact as a result of the contact portion 60 remaining near the opening 2402 of the tubular battery-side electric contactors 24. This makes the present invention more advantageous for achieving positive electrical contact between the electronic equipment-side electric contactor 44 and battery-side electric contactor 24.

Second Embodiment

A second embodiment will be described next.

The second embodiment differs from the first embodiment in the shape of the guide pin 46.

Figure 10:
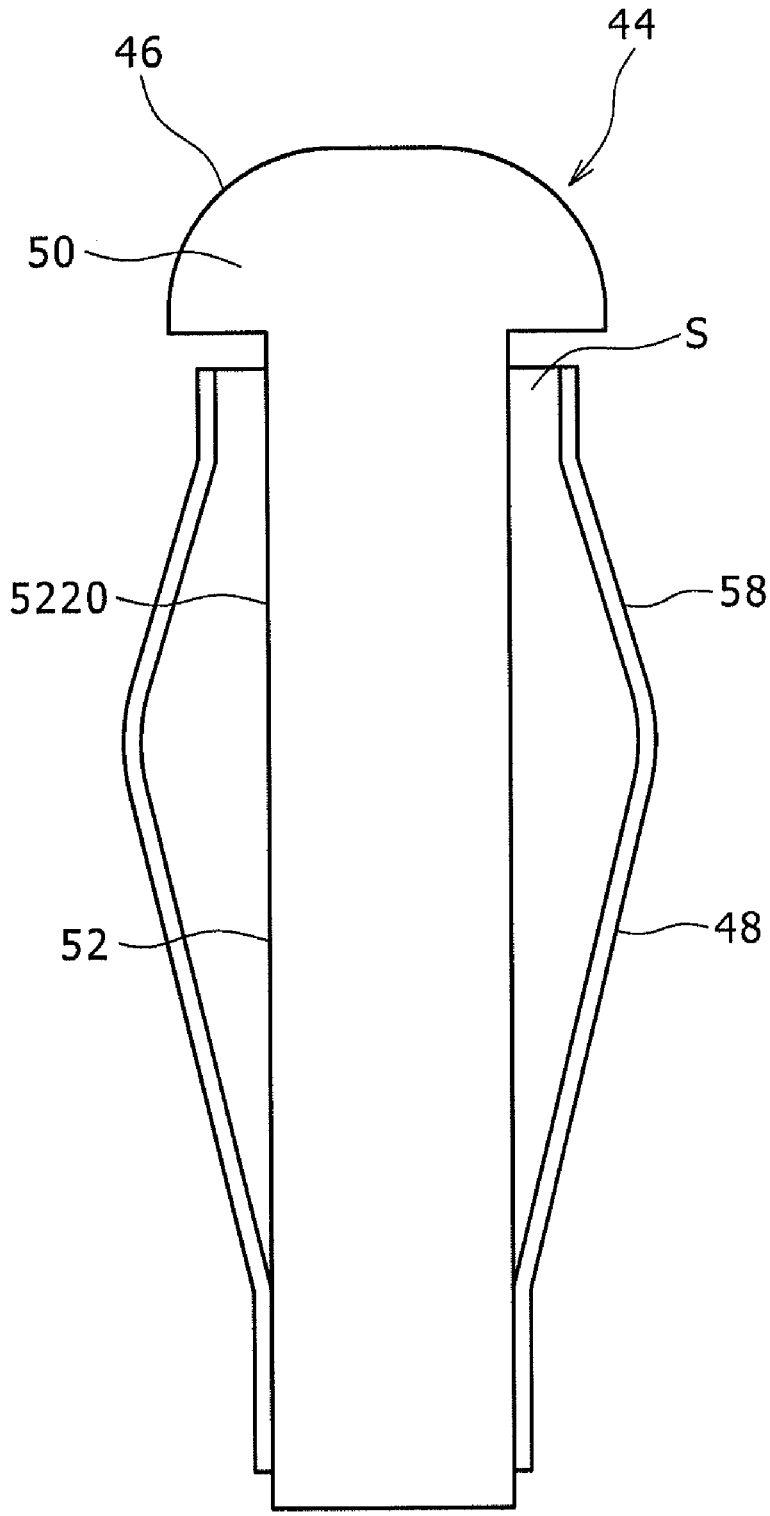
FIG. 10 is a sectional view of the electronic equipment-side electric contactor according to a second embodiment.

FIG. 10 is a sectional view of the electronic equipment-side electric contactor 44 according to the second embodiment.

In the first embodiment, the shaft portion 52 of the guide pin 46 includes the tip 5212, conical surface portion 5216 and base end 5214. In contrast, in the second embodiment, the shaft portion 52 includes a cylindrical surface 5220 having a uniform diameter smaller than the diameter of the head portion 50.

The second embodiment described above also provides the same advantageous effects as the first embodiment.

Third Embodiment

A third embodiment will be described next.

The third embodiment differs from the first embodiment in the shape of the guide pin 46.

Figure 11:
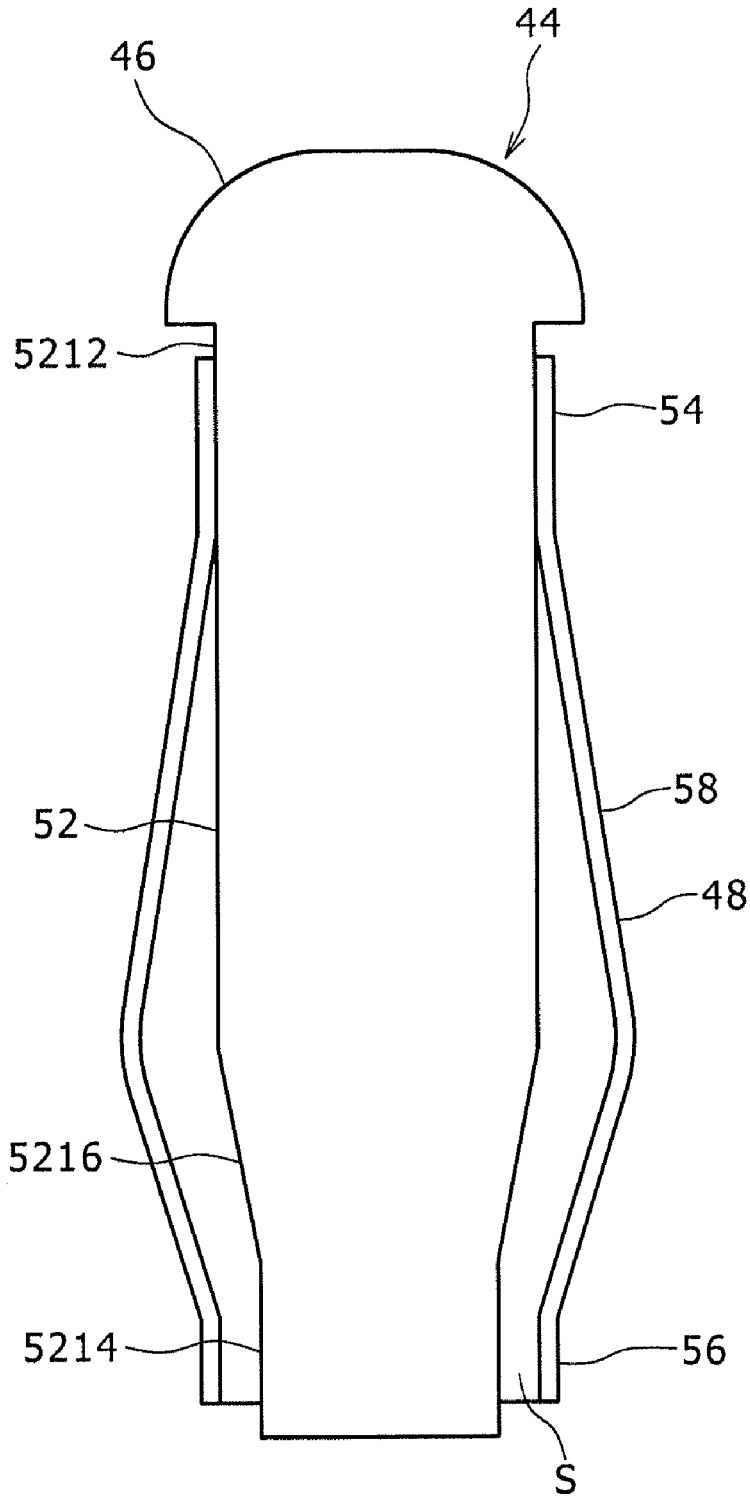
FIG. 11 is a sectional view of the electronic equipment-side electric contactor according to a third embodiment.

FIG. 11 is a sectional view of the electronic equipment-side electric contactor 44 according to the third embodiment.

In the first embodiment, the second tubular piece 56 is fastened to the base end 5214 of the shaft portion 52, and the first tubular piece 54 disposed with the annular space S provided between the tubular piece and the tip 5212 of the shaft portion 52. In contrast, in the third embodiment, the first tubular piece 54 is fastened to the tip 5212 of the shaft portion 52, and the second tubular piece 56 disposed with the annular space S provided between the tubular piece and the base end 5214 of the shaft portion 52.

Further, in the third embodiment, the shaft portion 52 of the guide pin 46 includes the tip 5212, conical surface portion 5216 and base end 5214. Unlike the first embodiment, the tip 5212 is formed larger in diameter than the base end 5214. The conical surface portion 5216 is oriented in the opposite direction to that in the first embodiment.

The third embodiment described above also provides the same advantageous effects as the first embodiment.

It should be noted that a case was described in each of the above embodiments in which the electronic equipment-side electric contactor 44 was provided in the imaging device 10. However, it is needless to say that the electric contactor according to the present invention is not limited to applications involving supply of power but can be used to supply a variety of signals in addition to power.

The present application contains subject matter related to that disclosed in Japanese Priority Patent Application JP 2008-113781 filed in the Japan Patent Office on Apr. 24, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An electric contactor comprising:

a guide pin; and a contact, wherein the guide pin is made of a conductive material and has a head portion and a shaft portion connected to the head portion, a tip of the shaft portion connected to the head portion being smaller in diameter than the head portion, the contact is made of a conductive and elastic thin plate spring material and has first and second tubular pieces and a plurality of contact pieces, the first tubular piece being wound around the tip of the shaft portion, the second tubular piece being wound around a base end of the shaft portion located on the opposite side of the head portion, and the plurality of contact pieces configured to connect the first and second tubular pieces together, the plurality of contact pieces extend along the longitudinal direction of the shaft portion in such a manner as to be spaced from each other in the circumferential direction of the shaft portion, and a middle portion along the extension direction of each of the plurality of contact pieces is located outward in the radial direction of an outer circumferential surface of the shaft portion, the middle portion being formed as a contact portion which can move toward or away from the outer circumferential surface, one of the first and second tubular pieces is brought into electrical conduction with the shaft portion as it comes into elastic contact with or is fastened to the outer circumferential surface of the shaft portion, and the other of the first and second tubular pieces is disposed with an annular space provided between the tubular piece and the outer circumferential surface of the shaft portion, wherein the middle portion along the extension direction of each of the plurality of contact pieces is bent in the form of an angle so as to be located more outward in the radial direction of the shaft portion than, the first and second tubular pieces, the contact portion includes the summit portion bent in the form of an angle, and when the distance from the second tubular piece to the summit portion of the angle is denoted L1 and that from the first tubular piece to the summit portion of the angle by L2, the relationships $L1>L2$ and $L2<(L1+L2)/2$ are satisfied.

2. The electric contactor of claim 1, wherein the middle portion along the extension direction of each of the plurality of contact pieces is located more outward in the radial direction of the shaft portion than the first and second tubular pieces.

3. The electric contactor of claim 1, wherein the first tubular piece is formed smaller in diameter than the head portion when wound around the tip of the shaft portion.

4. The electric contactor of claim 1, wherein each of the plurality of contact pieces has first and second sloping pieces and a summit portion, the first sloping piece extending from the first tubular piece to the second tubular piece while at the same time distancing itself further from the outer circumferential surface of the shaft portion, the second sloping piece extending from the second tubular piece to the first tubular piece while at the same time distancing itself further from the outer circumferential surface of the shaft portion, and the summit portion configured to connect the first and second sloping pieces, and the contact portion comprises the summit portion bent in the form of an angle.

5. Electronic equipment comprising an electric contactor, including a guide pin and a contact, wherein the guide pin is made of a conductive material and has a head portion and a shaft portion connected to the head portion, a tip of the shaft portion connected to the head portion being smaller in diameter than the head portion, the contact is made of a conductive and elastic thin plate spring material and has first and second tubular pieces and a plurality of contact pieces, the first tubular piece being wound around the tip of the shaft portion, the second tubular piece being wound around a base end of the shaft portion located on the opposite side of the head portion, and the plurality of contact pieces configured to connect the first and second tubular pieces together, the plurality of contact pieces extend along the longitudinal direction of the shaft portion in such a manner as to be spaced from each other in the circumferential direction of the shaft portion, and a middle portion along the extension direction of each of the plurality of contact pieces is located outward in the radial direction of an outer circumferential surface of the shaft portion, the middle portion being formed as a contact portion which can move toward or away from the outer circumferential surface, one of the first and second tubular pieces is brought into electrical conduction with the shaft portion as it comes into elastic contact with or is fastened to the outer circumferential surface of the shaft portion, and the other of the first and second tubular pieces is disposed with an annular space provided between the tubular piece and the outer circumferential surface of the shaft portion, the middle portion along the extension direction of each of the plurality of contact pieces is bent in the form of an angle so as to be located more outward in the radial direction of the shaft portion than the first and second tubular pieces, the contact portion includes the summit portion bent in the form of an angle, and when the distance from the second tubular piece to the summit portion of the angle is denoted by L1 and that from the first tubular piece to the summit onion of the angle by L2 the relationships L1>L2 and L2<(L1+L2)/2 are satisfied.

* * * * *